US008128384B2

(12) United States Patent
Mou

(10) Patent No.: US 8,128,384 B2
(45) Date of Patent: Mar. 6, 2012

(54) TUBE LOADING ASSEMBLY FOR PERISTALTIC PUMP

(76) Inventor: Duen-Gang Mou, Taipei (TW)

( * ) Notice: Subject to any disclaimer, the term of this patent is extended or adjusted under 35 U.S.C. 154(b) by 350 days.

(21) Appl. No.: 12/623,388

(22) Filed: Nov. 21, 2009

(65) Prior Publication Data

US 2010/0129248 A1 May 27, 2010

(30) Foreign Application Priority Data

Nov. 21, 2008 (TW) ..... 97220883 U

(51) Int. Cl.
*F04B 43/08* (2006.01)
*F04B 45/06* (2006.01)

(52) U.S. Cl. ..... 417/477.11; 417/477.8; 417/477.12

(58) Field of Classification Search ..... 417/477.7, 417/477.8, 477.9, 477.11, 477.12
See application file for complete search history.

(56) References Cited

U.S. PATENT DOCUMENTS 3,353,491 A * 11/1967 Bastian ..... 417/477.9
4,256,442 A 3/1981 Lamadrid et al.
D264,134 S 4/1982 Xanthopoulos
4,599,055 A 7/1986 Dykstra
4,708,604 A * 11/1987 Kidera ..... 417/477.11
4,735,558 A * 4/1988 Kienholz et al. ..... 417/477.2
7,722,338 B2 * 5/2010 Nordell et al. ..... 417/477.11

* cited by examiner

*Primary Examiner* — Devon C Kramer
*Assistant Examiner* — Ryan Gatzemeyer
(74) *Attorney, Agent, or Firm* — Pai Patent & Trademark Law Firm; Chao-Chang David Pai

(57) ABSTRACT

A spring mounted tube pressing member for peristaltic pumps allows loading and unloading of an elastic tube section between the tube pressing member and a continuously revolving rotor assembly by selectively moving between a locked position for fluid transfer and an open position for unhindered mounting and demounting of the tube section or a replaceable tube cassette. Not only is the pressure on the tube pressing member adjustable by the spring used, its dynamic pressure distribution on the tube section also prolongs the tube flex life and reduces fluid back mixing and pulsation in the tube.

11 Claims, 5 Drawing Sheets

TUBE LOADING ASSEMBLY FOR PERISTALTIC PUMP

BACKGROUND OF THE INVENTION

1. Field of the Invention

The present invention relates generally to the field of peristaltic pumps. More particularly, the present invention relates to a tube loading assembly comprising a tube pressing member riding on one arm of a two-arm torsion spring.

2. Description of the Related Art

A peristaltic pump moves and meters liquid through tubing of a dispensing circuit free of ambient contaminants. The dispensing circuit is releasably mounted to the pump and the tubing of the dispensing circuit is loaded in the pump. The rotating pump drives liquids through the tubing of the dispensing circuit. In a hospital or lab setting, the liquid transferred are body fluids, intravenous solutions, extracorporeal bloods, reagent solutions, nutrient culture media, etc.

A peristaltic pump assembly usually includes a base, a motor, a rotor assembly with circulating tube occluding rollers, and a tube pressing member with a tube track or raceway. In such arrangement, the space between rollers on the rotor and the pressing member is less than the diameter of the tubing and the tubing must be squeezed in. How one loads the tubing decides further variations of the assembly.

Early peristaltic pumps rely on hand-feeding for tube loading. Its benefit in structural simplicity is compromised because both hands are needed at the same time. Retractable mechanisms to move either the sliding rollers or the pressing member away from one another during tube loading are less cumbersome but add parts and cost, e.g., in both U.S. Pat. No. 4,256,442 to Lamadrid & Cullis and U.S. Pat. No. 4,599,055 to Dykstra, a movable pressing member is pivotally mounted on the base and allows single-handed tube loading. Further improvements allow automatic loading of the tubing loop to pump through progressively tightened space between rollers on a rotor and the housing of the modified pressing member (e.g. U.S. Pat. No. 4,861,242 to Finsterwald), or through a rotor with tube guiding grooves and notch to lower the tubing into the raceway (as in U.S. Pat. No. 5,387,088 to Knapp et al.), or through a further simplified self-loading version (as in U.S. Pat. No. 7,018,182 to O'Mahony & Behan). These improvements also aid loading of a disposable tube section into the pump between a pressing raceway and a rotor before use. Also available is a disposable tube cassette and the likes for use in a peristaltic pump as in U.S. Pat. No. D264,134 to Xanthopoulos. Methods for its quick loading and unloading are also desirable.

To accommodate a collapsible and resilient tube of different materials, sizes and degrees of compressibility, the tube pressing member and the opposing sliding rollers must be urged toward and occlude the tube section for fluid transfer. This tube compression force must not be so tight as to damage the tube or so loose as to lose pressure for flow. To prolong tube flex life, U.S. Pat. No. 4,559,040 to Horres & Moers has a removable pumping chamber portion so the tubing may be stored in the pump head without being pinched by the eccentric rotor. The device in U.S. Pat Pub 2006/0083644 (Zumbrum & Coates III) uses location of flanged ends of tubing section to absorb part of the tubing tension thereby extending its flex life. Further improvements employ means for dynamic compression force which gradually closes in or increases upon fluid entry and gradually opens up or decreases before exit. They are represented in U.S. Pat. No. 5,110,270 to Morrick using spring-loaded sliding rollers and in U.S. Pat. No. 5,230,614 to Zanger et al., in which a specific arcuate surface on one pressing pump head to move a fluid through the tube in one direction without creating undue fluid back pressure in an opposite direction. Reduced fluid pulsation or back mixing is a feature important for steady and precision dosing by a peristaltic pump.

Besides tube loading, tube caring and dynamic compression mechanisms tend to be mechanically complex, they are also difficult to make and use. Accordingly, the main objective of the present invention is a peristaltic pump that is simple to make, easy to load, unload and store, especially with a disposable tube section, not prone to finger pinching and does not aggravate the tubing flex or the inherent fluid pressure pulsation issue.

SUMMARY OF THE INVENTION

In summary, the present invention simplifies the mechanical design for tube loading and provides easy operation at the same time. When unloading, the tube pressing member swings wide open and exposes the pumping head for tube mounting and demounting without risk of finger pinching. This releasable and retractable tube pressing member simply swings back to a locked position for pump action and fluid flow.

A spring mounted tube pressing member is employed to simplify the make and use of a peristaltic pump. It loads and unloads an elastic tubing piece between a continuously circulating tube occluding rollers and a tube pressing member by selectively installing the spring and the accompanying tube pressing member in a locked loading position for fluid transfer, and in an open unloading position from the circulating tube occluding roller assembly for unhindered mounting and demounting of an elastic tube section as well as easy gravity or air back-pressure flushing of the system. Preferably, a pivotally mounted two-arm helical torsion spring meets the above need with a retractable tube pressing member mounted on one arm, and a pressuring device, which adjusts pressure on the tube pressing member, on the other arm.

Further benefit of the invention is the dynamic and decreasing pressure distribution on the tube pressing member in the direction of the fluid flow. This decreasing dynamic pressure not only aids the flex life of the tube section but also enables the occluded fluid to move through the tube in one direction while minimizing undue fluid back pressure in the opposite direction.

Additional objective in easy tube mounting and demounting is to provide quick and straightforward replacement of either stand-alone disposable tube cassette, or a disposable tube section attached to the tube pressing member.

DETAILED DESCRIPTION OF THE INVENTION

Figure 1:
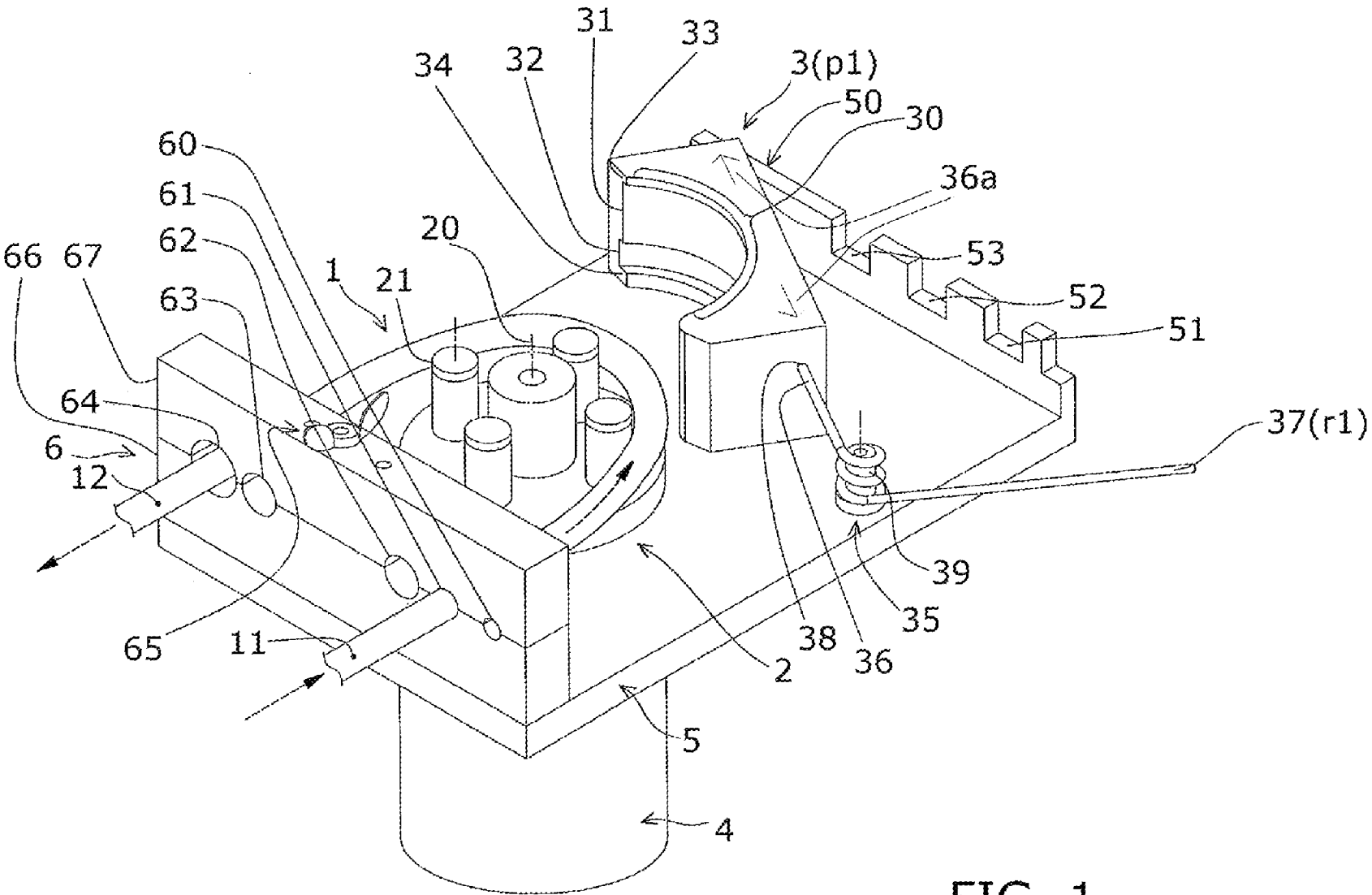
FIG. 1 is a perspective view of an assembled peristaltic pump in accordance with the present invention, when the torsion spring mounted retractable tube pressing member opens wide for tube mounting or tube pressing member replacement
Figure 2:
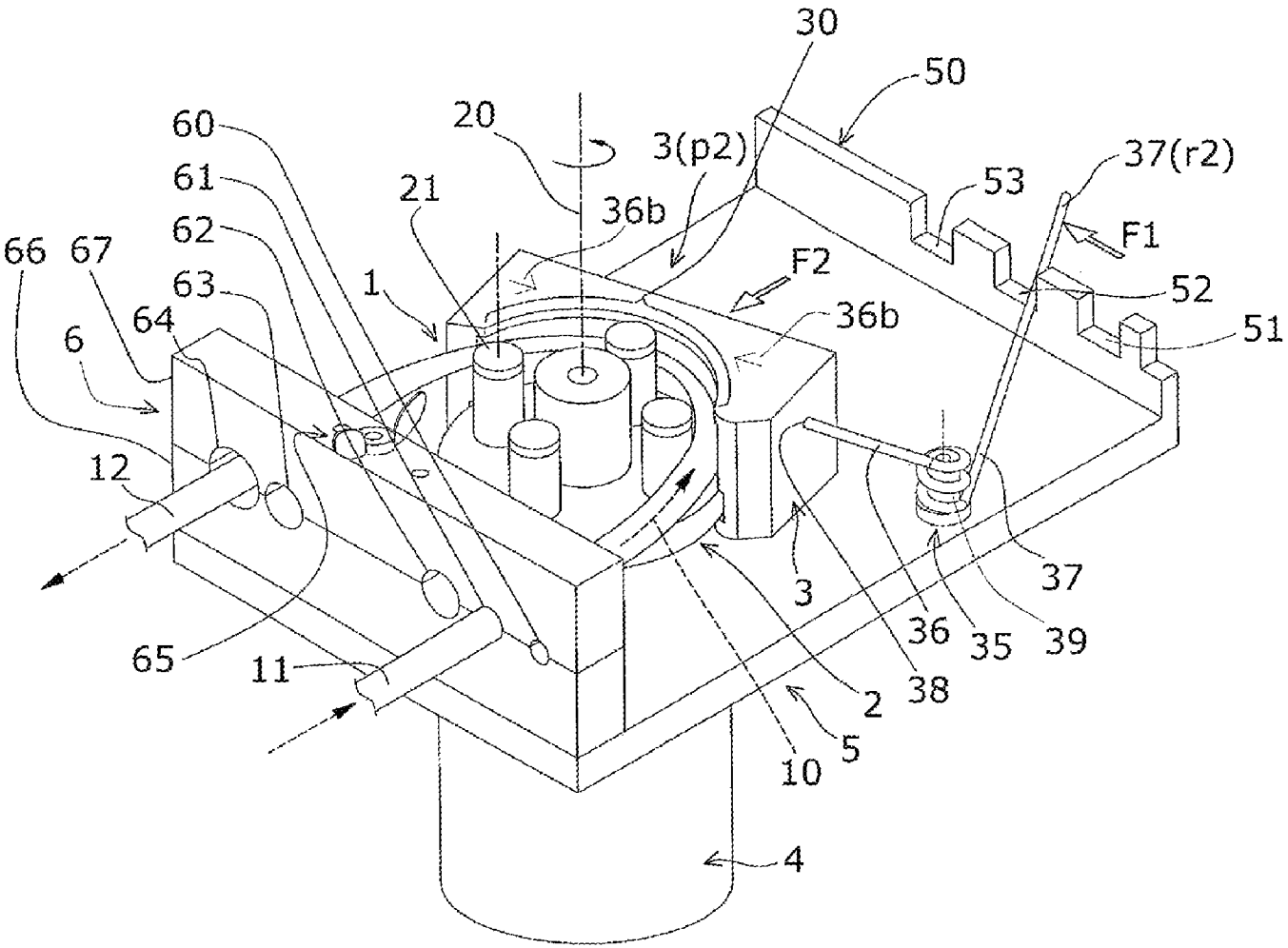
FIG. 2 is a perspective view of an assembled peristaltic pump in accordance with the present invention, when the torsion spring mounted retractable tube pressing member centers itself on the spring's tube locking arm and locks on the tube section and the tube occluding rotors by force from the spring's tube locking arm.

As shown in FIGS. 1 and 2, a peristaltic pump assembly in accordance with the present invention includes a base plate 5, a motor 4, a rotor assembly 2 with a plurality of circulating rollers 21, and a tube pressing member 3 with an arcuate side 30 forming a tube track 31. In such arrangement, the space between the rollers 21 on the rotor assembly 2 and the pressing member 3 is less than the diameter of the tube 1 and the tube 1 must be squeezed in between. The pump assembly of the present invention in an open (or unlocked) position with a tube section in place is shown in FIG. 1. An elastic tube section 1 is installed between a plurality of freely rotating rollers 21 installed on a rotor assembly 2 circulating about an axis 20 and a tube track 31 formed on a tube pressing member 3. The tube pressing member 3 is pressed and locked in the proximity of the circular orbit of the rollers 21 by force from a two-arm helical torsion spring 35 pivotally mounted on a bolt 39 fixed to the base plate 5. While the rotor assembly 2 circulates about the axis 20, the circular motion of the rollers 21 causes fluid transfer in the tube section 1 (as indicated by the arrows) by squeezing the tube section 1 against the tube track 31. The circular motion of the rollers 21 is driven by a motor 4. In this case, the tube pressing member 3 is releasably installed on the two-arm (36 and 37) helical torsion spring 35 at the working or locked position p2 and r2 (see FIG. 2) for carrying out fluid transfer, or at the retracted or open position p1 and r1 for loading or unloading the tube section 1 or replacing the tube pressing member 3. With the straight tube locking arm 36 of the torsion spring 35 inserted through its longitudinal through hole 38, the tube pressing member 3 rides along the straight tube locking arm 36 and can be removed or loaded in directions of 36*a*. When a disposable tube cassette is used as in U.S. Pat. No. D264,134 in place of the tube pressing member, the same retractable and arm sliding mechanism may be applied for quick change of the pumping tube.

FIG. 2 shows the pump assembly of the present invention in the locked position with a tube section 1 and fluid flow 10 in place. The arcuate side 30 of the tube pressing member 3 centers itself through sliding in the directions 36*b* on the tube locking arm 36 when locked against the circulating rollers 21 on the rotor assembly 2. The pressure on the pumping tube section 1 comes from the force F2 exerted by the tube locking arm 36 of the two-arm helical torsion spring 35, which in turn comes from the bending force or stress F1 exerted on the spring locking arm 37 when set inside any of the spring locking slots 51, 52, 53 located on the extended base plate 50. The bending force F1, and therefore the force F2 increases as the spring locking arm 37 moves from the spring locking slot 51 to 52, and from 52 to 53.

Figure 5:
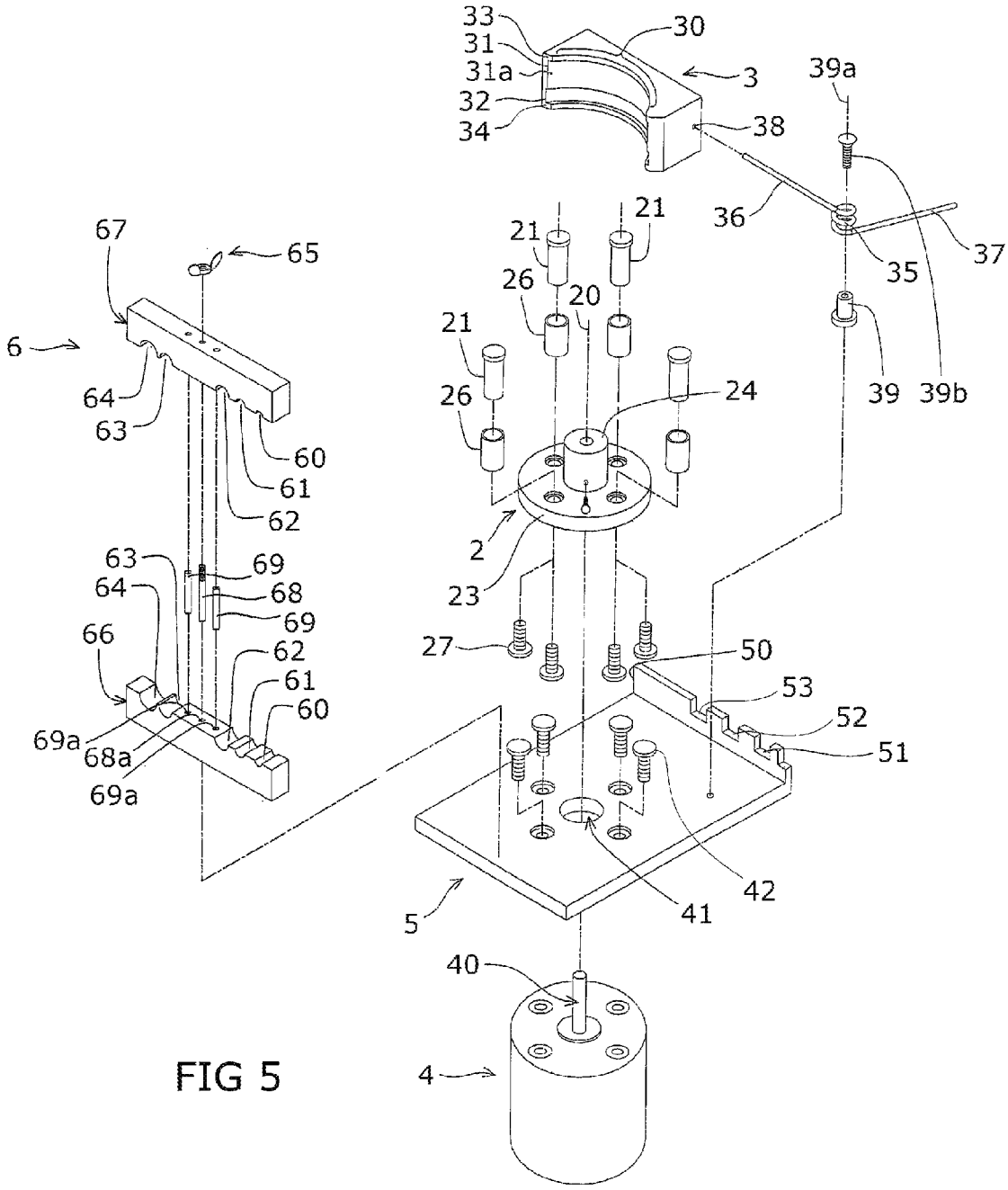
FIG. 5 is a perspective exploded view of the peristaltic pump shown in FIG. 1.

A tube anchoring clamp 6 is provided to withhold the friction pull on the tube from the rollers 21 and the tube pressing member 3, as shown in FIGS. 1 and 2. The tube anchoring clamp 6 comprises two matching halves—one anchoring half 66 fixed to the base plate 5 and one removable half 67. The anchoring half 66 and the removable half 67 are connected by a tubing clamp anchoring bolt 68 (see FIG. 5) and clamped down together by a wing nut 65. Holes of assorted sizes 60-64 are centered at the interface of the two matching halves for selected tube sizes. Holes 60/61/62 are slightly smaller than the tubes they serve, hence can hold the inlet portion 11 of the tube section 1 firmly when clamped down tight by the wing nut 65. At the outlet end 12, the holes 63/64 are slightly larger than the tubes they serve, therefore, allow excess tube slack fed by the circulating rollers 21 to tunnel out the pump head area through the holes 63/64.

The dynamic and decreasing pressure distribution on the tube locking arm 36 and the tube pressing member 3 along the direction of the fluid flow in this invention prolongs the tubing flex life and reduces fluid back mixing and pulsation in the tube. The physics of the mechanical assembly in FIG. 2 is shown schematically in FIG. 3. The pressure on the wall of the tube section 1 is the force of the tube pressing member 3 applied against the circulating rollers 21 on the rotor assembly 2, which is driven by the motor 4 to rotate about the rotation axis 20 in the direction 22. The force F2 on the tube pressing member 3 comes from the tube locking arm 36 of the two-arm helical torsion spring 35, which is pivotally mounted on the top of the base plate 5. The spring locking arm 37 of the torsion spring 35 can move parallel to the top plane of the base plate 5 between a locked position r2 and an open or unlocked position r1 (see FIGS. 2 and 1 respectively). While in the locked position r2, the tension force F1 of the torsion spring 35 is transmitted from the spring locking arm 37 at one of the spring locking slots 51-53. The spring tension force F1 must be strong enough to overcome the sum of the back pressure at fluid destination, the gravitational force of the fluid or the so called liquid head in the dispensing circuit and the resistance of the resilient tube wall material against the rollers 21 and the tube pressing member 3 in the fluid pumping position p2. The forces F1 and F2 from the helical torsion spring 35 exerted on the tube locking arm 36 follows the principle of leverage which states that the amount of torque exerted by a spring arm or lever is the product of force and distance on the arm or lever from the fulcrum. Hence the forces F2 along the longitudinal or tube-axial direction of the tube pressing member 3 decreases with the flow 10 or in the pumping direction 22. In addition to occluding the fluid to move through the tube in a pressure-decreasing direction, hence minimizing undue fluid back pressure in the opposite direction, this decreasing dynamic force F2 pressed on the pumping tube section 1 in the direction of pumping 22 also prolongs the flex life of the tube section 1.

Figure 3:
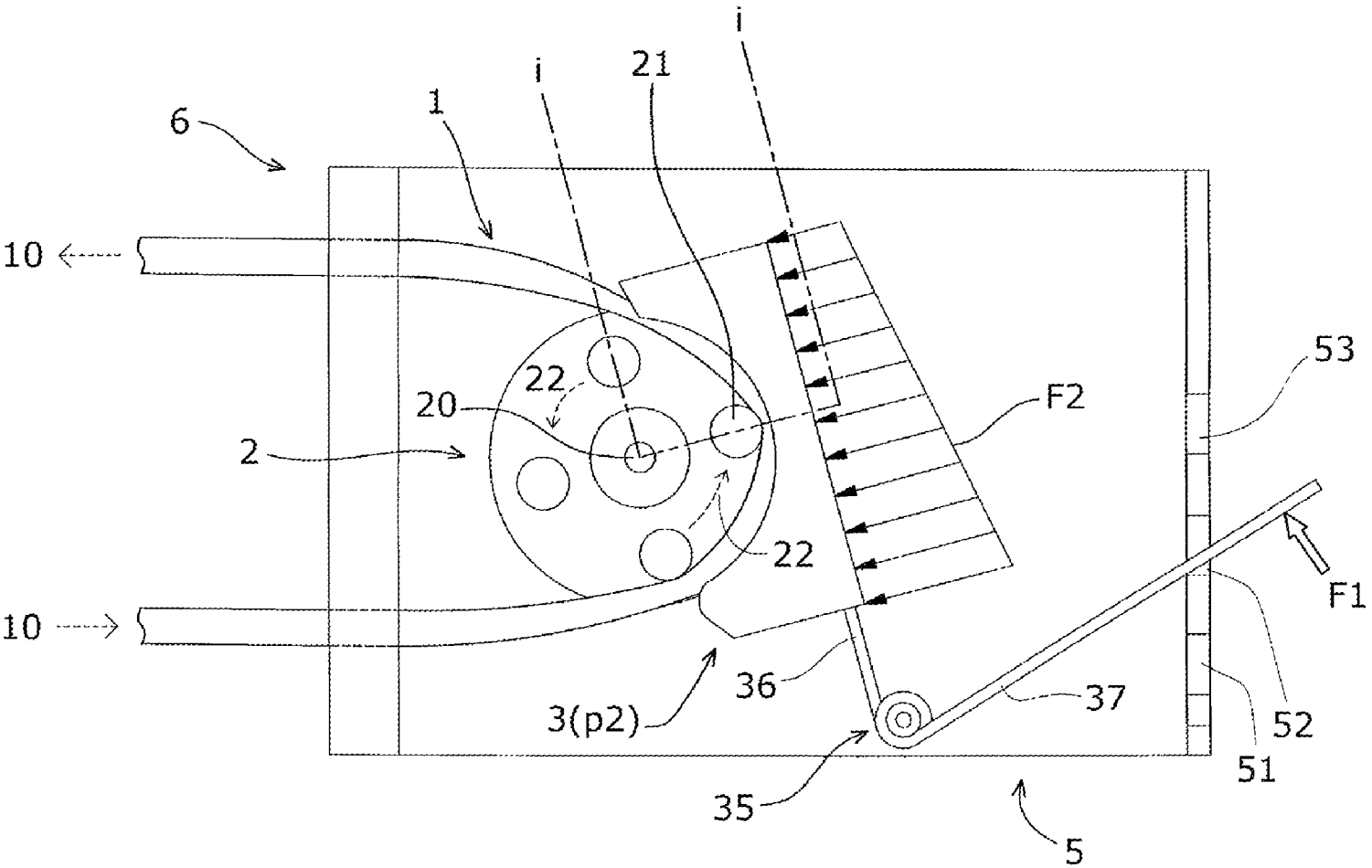
FIG. 3 is a schematic description of the torsion spring mounted tube pressing member corresponding to FIG. 2 in accordance with the present invention, when the tube pressing member and the tube section are pressed by the dynamic compression force from the spring's tube locking arm.
Figure 4:
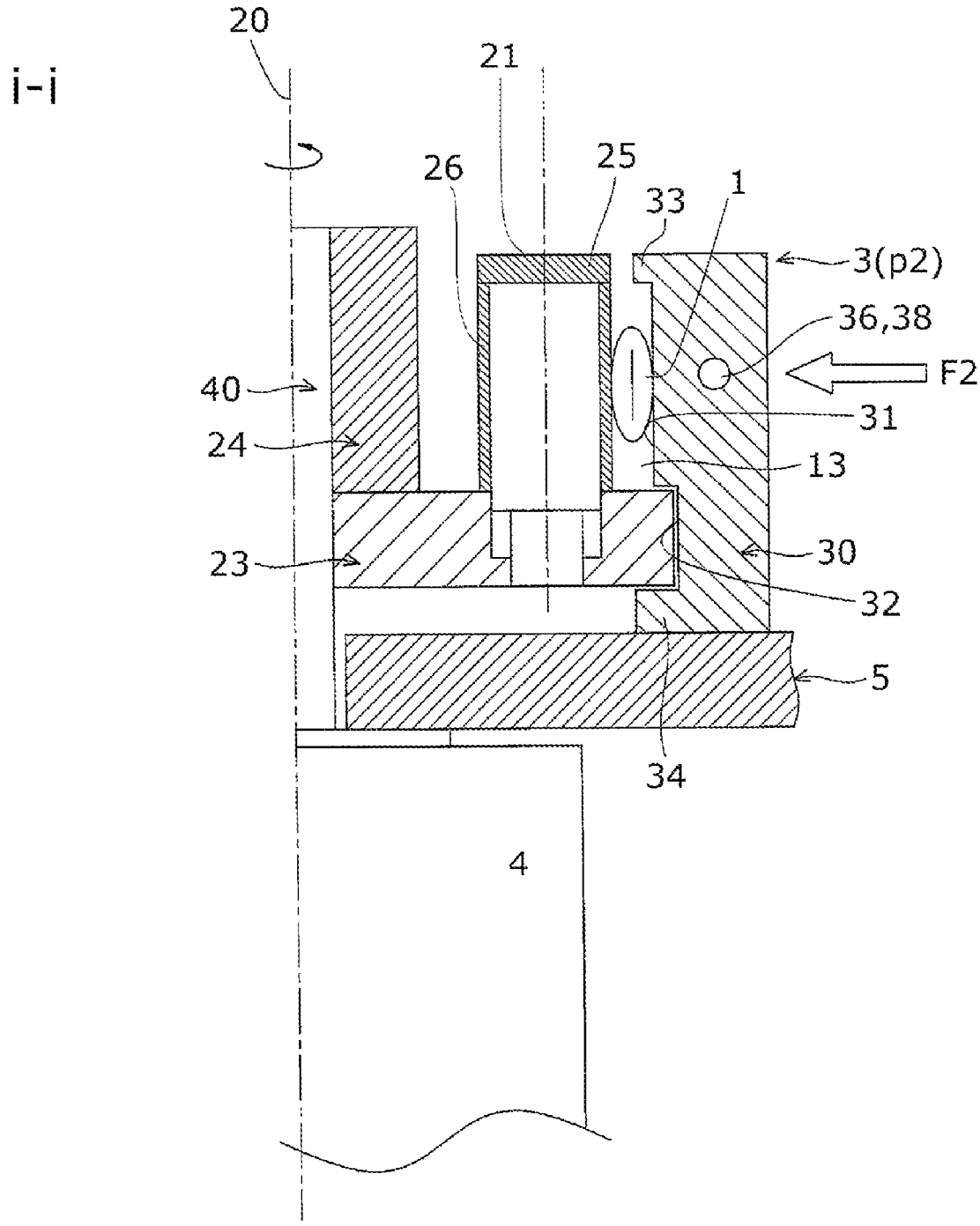
FIG. 4 is a cross-sectional view of the torsion spring mounted retractable tube pressing member with its tube track and rotor-guiding groove and track guard in accordance with the present invention.

One design of the pump head with corresponding tube pressing member 3 is further disclosed by taking a cross-sectional view defined by planes i and i perpendicular to the base plate 5 in FIG. 3. This is shown in FIG. 4. The pumping head includes a rotating rotor disc 23, a roller 21 with a circulating roller core with attached self-lubricating bearings 26 and an end cap 25, and the tube pressing member 3 under spring bending stress or pressure F2. The tube section 1, embedded at the arcuate side 30 of the tube pressing member 3 in the tube track 31 and the pumping chamber 13, is protected and guided at the outside by a track guard 33 and at the inside by the rotor disc 23 itself. The circulating rotor assembly 2 is mounted onto a motor drive 40 at its center column 24 and the motor is mounted to the base plate 5. Critical dimension of the tube pumping chamber 13 is further defined by the width of the tube track 31 and the depth of rotor-guiding groove 32 at the topside of the rotor disc 23. The former dictates the circumference of the tube used, while the latter the minimum chamber clearance in the radial direction of the rotor assembly 2, hence the tube wall thickness, for tubing protection from excessive spring pressure. Hugging the rim of the rotor assembly 2, the track locking guide 34 next to the underside of the arcuate side 30 of the pressing member 3 is to fit in the gap between the rotating rotor disc 23 and the base plate 5 under spring tension F2 to assure longitudinal or tube-axial direction stability of the tube pressing member 3 in the direction of flow. The longitudinal through hole 38 of the pressing member 3 and the tube locking arm 36 are conveniently center placed relative to the tube track 31 for full compression on the tube section 1.

A full exploded view of the peristaltic pump described above without the pumping tube is shown in FIG. 5. Tube track area 31*a*, torsion spring pivot axis 39*a*, spring mounting screw 39*b*, roller mounting screws 27, motor mounting screws 42, motor drive penetration port 41, tubing clamp anchoring bolt 68 and port 68*a*, and a pair of tubing clamp guiding posts 69 and ports 69*a* are further revealed as one practice example.

What is claimed is:

1. A tube loading assembly for a peristaltic pumping head having a rotor assembly with a plurality of circulating rollers, the tube loading assembly comprising:

a base plate for positioning the rotor assembly above a top surface thereof;

a helical torsion spring having a first extended end and a second extended end at a predetermined angle with the first extended end, the helical torsion spring being pivotally mounted on the top surface of the base plate;

a spring tension adjustment device disposed on the base plate, the spring tension adjustment device being capable of interacting with the second extended end of the helical torsion spring to put a bending moment within a range of magnitude on the helical torsion spring; and a tube pressing member having an arcuate side, the tube pressing member being retractably mounted on the first extended end of the helical torsion spring;

wherein when the second extended end of the helical torsion spring interacts with the spring tension adjustment device on the base plate, the first extended end of the helical torsion spring will press the arcuate side of the tube pressing member toward the rotor assembly to form a tube pumping chamber between the arcuate side and the circulating rollers for a section of a tube to pass through for peristaltic pumping; and when the second extended end of the helical torsion spring does not interact with the spring tension adjustment device on the base plate, the first extended end of the helical torsion spring is free to swing with the tube pressing member to move the arcuate side away from the rotor assembly for tube loading and unloading or tube pressing member replacement.

2. The tube loading assembly of claim 1, wherein the tube pressing member is capable of sliding along the first extended end, so that the arcuate side of the tube pressing member automatically slides to a stable position against the circulating rollers during peristaltic pumping.

3. The tube loading assembly of claim 1, wherein the spring tension adjustment device is a plurality of raised slots.

4. The tube loading assembly of claim 1, wherein the arcuate side of the tube pressing member has a track guard protruding along a top portion thereof, a rotor-guiding groove near a bottom edge thereof for accommodating a rotor disc of the rotor assembly, and a tube track between the track guard and the rotor-guiding groove.

5. The tube loading assembly of claim 1, wherein the tube pressing member has a flat bottom surface that slides on the top surface of the base plate when the tube pressing member swings toward or away from the rotor assembly.

6. The tube loading assembly of claim 1, wherein said tube pressing member is a tube cassette with a built-in tube section.

7. The tube loading assembly of claim 1, wherein the tube pressing member has a longitudinal through hole and the first extended end of the helical torsion spring is inserted through the through hole for mounting the tube pressing member.

8. The tube loading assembly of claim 1, further comprising a tube anchoring clamp installed on the base plate, wherein the tube anchoring clamp is disposed with a plurality of holes of assorted sizes, each hole being capable of holding the tube of a different size.

9. The tube loading assembly of claim 8, wherein the tube anchoring clamp includes a top half and a bottom half, the plurality of holes are formed between the top half and the bottom half, and the top half and the bottom half are clamped together to hold the tube.

10. The tube loading assembly of claim 9, wherein the top half and the bottom half are clamped together by a bolt and a wing nut.

11. A peristaltic pumping head comprising a rotor assembly with a plurality of circulating rollers, a tube section, and a tube loading assembly, the tube loading assembly comprising:

a base plate for positioning the rotor assembly above a top surface thereof;

a helical torsion spring having a first extended end and a second extended end at a predetermined angle with the first extended end, the helical torsion spring being pivotally mounted on the top surface of the base plate;

a spring tension adjustment device disposed on the base plate, the spring tension adjustment device being capable of interacting with the second extended end of the helical torsion spring to put a bending moment within a range of magnitude on the helical torsion spring; and a tube pressing member having an arcuate side, the tube pressing member being retractably mounted on the first extended end of the helical torsion spring;

wherein when the second extended end of the helical torsion spring interacts with the spring tension adjustment device on the base plate, the first extended end of the helical torsion spring will press the arcuate side of the tube pressing member toward the rotor assembly to form a tube pumping chamber between the arcuate side and the circulating rollers for the tube section to pass through for peristaltic pumping; and when the second extended end of the helical torsion spring does not interact with the spring tension adjustment device on the base plate, the first extended end of the helical torsion spring is free to swing with the tube pressing member to move the arcuate side away from the rotor assembly for tube loading and unloading or tube pressing member replacement.

* * * * *